US011293125B2

(12) United States Patent
Middendorf et al.

(10) Patent No.: US 11,293,125 B2
(45) **Date of Patent: *Apr. 5, 2022**

(54) MAT HAVING LONG AND SHORT INORGANIC FIBERS

(71) Applicant: 3M INNOVATIVE PROPERTIES COMPANY, St. Paul, MN (US)

(72) Inventors: Claus Middendorf, Neuss (DE); Juergen Strasser, Neuss (DE); Knut Schumacher, Neuss (DE)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/809,690

(22) Filed: Mar. 5, 2020

(65) Prior Publication Data

US 2020/0199796 A1 Jun. 25, 2020

Related U.S. Application Data

(63) Continuation of application No. 15/678,454, filed on Aug. 16, 2017, now Pat. No. 10,662,560, which is a (Continued)

(30) Foreign Application Priority Data

Dec. 14, 2005 (GB) ..... 0525375

(51) Int. Cl.
*D04H 1/4218* (2012.01)
*D04H 5/12* (2012.01)
(Continued)

(52) U.S. Cl.
CPC ..... *D04H 1/4218* (2013.01); *D04H 1/4209* (2013.01); *D04H 1/43835* (2020.05);
(Continued)

(58) Field of Classification Search
CPC ..... D04H 1/4218; D04H 1/46; D04H 1/4209; D04H 1/4382; D04H 5/02; D04H 5/12;
(Continued)

(56) References Cited

U.S. PATENT DOCUMENTS 3,916,057 A 10/1975 Hatch et al.
4,011,651 A 3/1977 Bradbury et al.
(Continued)

FOREIGN PATENT DOCUMENTS

EP 1388649 2/2004
JP S55-180789 U 6/1979
(Continued)

*Primary Examiner* — Jeremy R Pierce
(74) *Attorney, Agent, or Firm* — 3M Innovative Properties Company

(57) ABSTRACT

The present invention provides a mat comprising a layer having a mixture of long and short fibers wherein said short fibers have a length of not more than about 13 mm and wherein said long fibers have a length of at least about 20 mm and wherein the amount of said short fibers is at least about 3% by weight based on the total weight of said mixture of long and short fibers.

20 Claims, 1 Drawing Sheet

Related U.S. Application Data continuation of application No. 12/097,167, filed as application No. PCT/US2006/047428 on Dec. 13, 2006, now Pat. No. 9,765,458.

(51) Int. Cl.

| | |
|---|---|
| ***D04H 1/4209*** | (2012.01) |
| ***D04H 1/46*** | (2012.01) |
| ***D04H 5/02*** | (2012.01) |
| ***D04H 13/00*** | (2006.01) |
| ***F01N 3/28*** | (2006.01) |
| ***D04H 1/4382*** | (2012.01) |

(52) U.S. Cl.

CPC ..... *D04H 1/43838* (2020.05); *D04H 1/46* (2013.01); *D04H 5/02* (2013.01); *D04H 5/12* (2013.01); *D04H 13/00* (2013.01); *F01N 3/2864* (2013.01); *F01N 3/2853* (2013.01); *Y10T 156/10* (2015.01); *Y10T 156/1062* (2015.01); *Y10T 428/26* (2015.01)

(58) Field of Classification Search

CPC .... F01N 3/2864; F01N 3/2853; Y10T 156/10; Y10T 156/1062; Y10T 428/26

See application file for complete search history.

(56) References Cited

U.S. PATENT DOCUMENTS

| | | | | |
|---|---|---|---|---|
| 4,181,514 | A | 1/1980 | Lefkowitz et al. | |
| 4,269,887 | A | 5/1981 | Sonobe et al. | |
| 4,305,992 | A | 12/1981 | Langer et al. | |
| 4,929,429 | A | 5/1990 | Merry | |
| 5,028,397 | A | 7/1991 | Merry | |
| 5,145,811 | A | 9/1992 | Lintz et al. | |
| 5,151,253 | A | 9/1992 | Merry et al. | |
| 5,250,269 | A | 10/1993 | Langer | |
| 5,290,522 | A | 3/1994 | Rogers et al. | |
| 5,380,580 | A | 1/1995 | Rogers et al. | |
| 5,580,532 | A | 12/1996 | Robinson et al. | |
| 5,736,109 | A | 4/1998 | Howorth et al. | |
| 5,996,228 | A | 12/1999 | Shoji et al. | |
| 6,051,193 | A | 4/2000 | Langer et al. | |
| 6,231,818 | B1 | 5/2001 | TenEyck | |
| 7,276,280 | B2 | 10/2007 | Dinwoodie et al. | |
| 9,765,458 | B2 * | 9/2017 | Middendorf ..... | D04H 1/43835 |
| 10,662,560 | B2 * | 5/2020 | Middendorf ..... | D04H 1/43838 |

FOREIGN PATENT DOCUMENTS

| | | |
|---|---|---|
| JP | 6299846 | 10/1994 |
| JP | 2002/047070 | 2/2002 |
| WO | WO 03/050397 | 6/2003 |
| WO | WO 2004/054942 | 7/2004 |
| WO | WO 2005/003530 | 1/2005 |

* cited by examiner

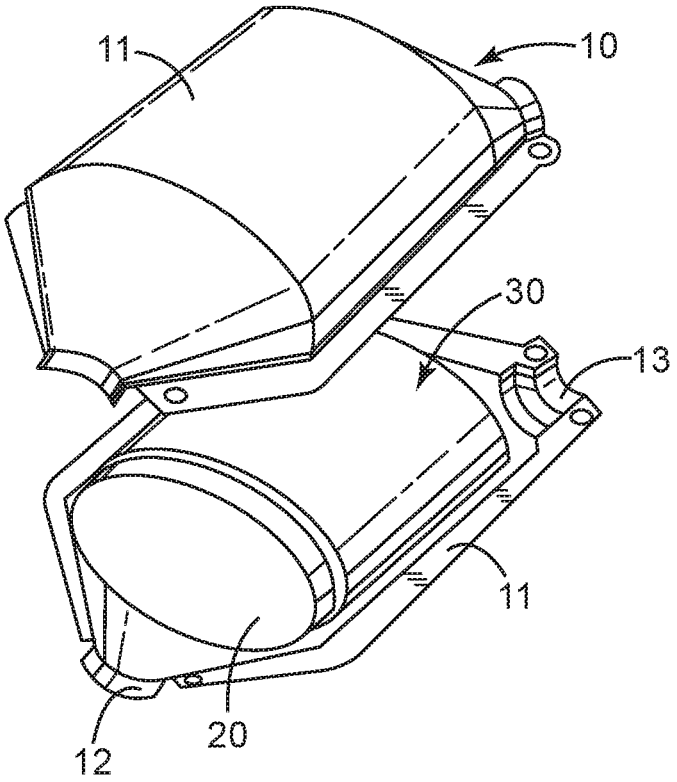
11
10
30
13
11
12
20

MAT HAVING LONG AND SHORT INORGANIC FIBERS

CROSS REFERENCE TO RELATED APPLICATIONS

This application is a continuation of Ser. No. 15/678,454, filed Aug. 16, 2017, now issued as U.S. Pat. No. 10,662,560, which is a continuation of Ser. No. 12/097,167, filed Oct. 16, 2008, now issued as U.S. Pat. No. 9,765,458, which is a 371 of PCT/US2006/047428, filed Dec. 13, 2006, which claims priority to United Kingdom 0525375.2, filed Dec. 14, 2005, the disclosures of which are incorporated by reference in their entireties herein.

FIELD OF THE INVENTION

The present invention relates to a mat having a layer of long and short inorganic fibers providing an insulating effect.

BACKGROUND

Pollution control devices typically comprise a metal housing with a monolithic element securely mounted within the casing by a resilient and flexible mounting mat. Pollution control devices are universally employed on motor vehicles to control atmospheric pollution. Generally the pollution control device is designed according to the type of exhaust gas to be treated because the composition of the exhaust as well as temperatures thereof may be different depending on the type of engine causing the exhaust. Accordingly, pollution control devices are known to be used to treat the exhaust of gasoline engines as well as diesel engines. Pollution control devices include catalytic converters and particulate filters or traps. Two types of devices are currently in widespread use—catalytic converters and diesel particulate filters or traps. Catalytic converters contain a catalyst, which is typically coated on a monolithic structure mounted within a metallic housing. The monolithic structures are typically ceramic, although metal monoliths have also been used. The catalyst oxidizes carbon monoxide and hydrocarbons and reduces the oxides of nitrogen in automobile exhaust gases to control atmospheric pollution.

Diesel particulate filters or traps are typically wall flow filters, which have honeycombed, monolithic structures typically made from porous crystalline ceramic materials. Alternate cells of the honeycombed structure are typically plugged such that exhaust gas enters in one cell and is forced through the porous wall to an adjacent cell where it can exit the structure. In this way, the small soot particles that are present in diesel exhaust gas are collected.

The monoliths and in particular the ceramic pollution control monoliths, used in pollution control devices are fragile and susceptible to vibration or shock damage and breakage. They have a coefficient of thermal expansion generally an order of magnitude less than the metal housing which contains them. This means that as the pollution control device is heated the gap between the inside peripheral wall of the housing and the outer wall of the monolith increases. Likewise, as the temperature of the pollution control device drops (e.g., when the engine is turned off), this gap decreases. Even though the metallic housing undergoes a smaller temperature change due to the insulating effect of the mat, the higher coefficient of thermal expansion of the metallic housing causes the housing to expand to a larger peripheral size faster than the expansion of the monolithic element. This higher coefficient of thermal expansion also causes the metal housing to shrink to a smaller peripheral size faster than the monolithic element. Thermal cycling and these resulting physical changes can occur hundreds or even thousands of times during the life and use of the pollution control device.

To avoid damage to pollution control elements such as ceramic monoliths (e.g., from road shock and vibrations), to compensate for the thermal expansion difference, and to prevent exhaust gases from passing between the monolith and metal housing (thereby bypassing the catalyst and/or filter), mounting mats are disposed between the pollution control element and the housing. These mats must exert sufficient pressure to hold the pollution control element in place over the desired temperature range but not so much pressure as to damage the pollution control element (e.g., a ceramic monolith).

Many of the mounting mats described in the art have been developed for mounting the catalyst carrier of catalytic converters for treatment of exhaust from gasoline engines which typically operate at high temperature. Known mounting mats include intumescent sheet materials comprised of ceramic fibers, intumescent materials and organic and/or inorganic binders. Intumescent sheet materials useful for mounting a catalytic converter in a housing are described in, for example, U.S. Pat. No. 3,916,057 (Hatch et al.), U.S. Pat. No. 4,305,992 (Langer et al.) U.S. Pat. No. 5,151,253 (Merry et al.) U.S. Pat. No. 5,250,269 (Langer) and U.S. Pat. No. 5,736,109 (Howorth et al.). In recent years, non-intumescent mats comprised of polycrystalline ceramic fibers and binder have been used especially for the so-called ultra thin-wall monoliths, which have significantly lower strength due to their extremely thin cell walls. Examples of non-intumescent mats are described in, for example, U.S. Pat. No. 4,011,651 (Bradbury et al.), U.S. Pat. No. 4,929,429 (Merry), U.S. Pat. No. 5,028,397 (Merry), U.S. Pat. No. 5,996,228 (Shoji et al.), and U.S. Pat. No. 5,580,532 (Robinson et al.). Polycrystalline fibers are much more expensive than normal, melt formed ceramic fibers and, therefore, mats using these fibers are only used where absolutely necessary as, for example, with ultra thin-wall monoliths.

U.S. Pat. No. 5,290,522 describes a catalytic converter having a non-woven, mounting mat comprising at least 60% by weight shot-free high strength magnesium aluminosilicate glass fibers having a diameter greater than 5 micrometers. The mounting mats taught in this reference are primarily intended for use in high temperature applications as can be seen from the test data in the examples where the mats are subjected to exhaust gas temperatures of more than 700° C.

U.S. Pat. No. 5,380,580 describes a flexible non-woven mat comprising shot-free ceramic oxide fibers selected from the group consisting of (a) aluminosilicate fibers comprising aluminum oxide in the range from 60 to about 85% by weight and silicon oxide in the range of 40 to about 15% by weight silicon oxide, based on the total weight of said aluminosilicate-based fibers, said aluminosilicate-based fibers being at least 20% by weight crystalline (b) crystalline quartz fibers and (c) mixtures of (a) and (b), and wherein the combined weight of said aluminosilicate-based fibers and said crystalline quartz fibers is at least 50% by weight of the total weight of said non-woven mat. The flexible non-woven mat can additionally comprise high strength fibers selected from the group consisting of silicon carbide fibers, silicon nitride fibers, carbon fibers, silicon nitride fibers, glass fibers, stainless steel fibers, brass fibers, fugitive fibers, and mixtures thereof.

Diesel Oxidation Catalysts (DOC's) are used on modern diesel engines to oxidize the soluble organic fraction (SOF) of the diesel particulate emitted. Because of the relatively low exhaust gas temperatures, mounting of DOC's with conventional mounting materials has been problematic. The exhaust gas of modern diesel engines such as turbo-charged direct injection (TDI) engines may never exceed 300° C. This temperature is below the temperature needed to expand most intumescent mats. This expansion is needed to develop and maintain appropriate pressure within the catalytic converter.

U.S. Pat. No. 6,231,818 attempts to overcome the present difficulties of mounting low-temperature, diesel catalysts by using non-intumescent mats comprised of amorphous, inorganic fibers. Although it is taught in this patent that the mat can be organic binder free, it appears that several of the mats used in the examples require the use of substantial amounts of binders. Moreover, it was found that the mounting mats disclosed in this US patent, still do not adequately perform for treatment of exhaust from diesel engines, in particular TDI engines.

EP 1388649 discloses a pollution control device suitable for use with a diesel engine, comprising a diesel pollution control monolith arranged in a metallic casing with non-woven mat disposed between the metallic casing and the diesel pollution control monolith. The non-woven mat is a non-intumescent mat comprising at least 90% by weight based on the total weight of the mat of chopped magnesium aluminium silicate glass fibers that have a number average diameter of 5 μm or more and a length of 0.5 to 15 cm and the glass fibers are needle punched or stitch bonded and the mat being free or substantially free of organic binder.

SUMMARY

While the mats disclosed in the prior art can provide good properties, there continues to be a desire to further improve the mat.

It would further be a desire to obtain such improved mats that can be manufactured in an easier and more convenient way and at a more affordable cost. Additionally, it was a desire to find further mats that show good to excellent performance in at least one or more of the following tests: Real Condition Fixture Test (RCFT), Cyclical Compression Test, and Hot Vibration Test. Desirably, the mat also has good health, safety and environmental properties.

In one aspect, the invention provides a mat comprising a layer having a mixture of long and short inorganic fibers wherein said short fibers have a length of not more than about 13 mm and wherein said long fibers have a length of at least about 20 mm and wherein the amount of said short fibers is at least about 3% by weight based on the total weight of said mixture of long and short fibers.

In a particular embodiment, the mixture of long and short fibers is a mixture of long and short ceramic fibers that are continuously formed and chopped or otherwise segmented (e.g., by breaking the fibers in subsequent fiber or mat processing) to a desired length.

In a particular embodiment of the present invention the mat comprises a layer having at least about 90% by weight, based on the total weight of the layer, of magnesium aluminium silicate glass fibers, the glass fibers comprising a mixture of long and short fibers wherein the short fibers have a length of not more than about 13 mm and wherein the long fibers have a length of at least about 20 mm and wherein the amount of the short fibers is at least about 3% by weight based on the total weight of the glass fibers.

It has been found that the mat has beneficial properties, for example, the cold holding power as measured by the compression test set forth in the examples can be improved. It is desirable for the present mats, comprising such longer and shorter fibers, to exhibit static compression test results of at least about 200 kPa and, preferably, at least about 250 kPa. Also, good results can be achieved with the present mats in the hot vibration test.

In another aspect, the invention provides a method of making a mat. The method comprises: providing a plurality of continuously formed inorganic fibers; segmenting the continuously formed inorganic fibers into long and short fibers, with the short fibers having a length of not more than about 13 mm and the long fibers having a length of at least about 20 mm; mixing the long and short fibers together to form a fiber mixture; and forming a mat using the mixture of long and short fibers. The segmenting step can comprise breaking the long and short fibers in the fiber mixture during the mat forming step to produce at least one of short fibers having a length of not more than about 13 mm and the long fibers having a length of at least about 20 mm. The segmenting step can also comprise chopping continuously formed inorganic fibers into long and short fibers to produce at least one of short fibers having a length of not more than about 13 mm and the long fibers having a length of at least about 20 mm. The method can further comprise chopping the continuously formed inorganic fibers into longer than desired lengths, before performing the segmenting operation.

The term 'magnesium aluminium silicate glass fibers' includes glass fibers that comprise oxides of silicon, aluminium and magnesium without excluding the presence of other oxides, in particular other metal oxides.

BRIEF DESCRIPTION OF THE DRAWINGS

Solely for the purpose of illustration and better understanding of the invention and without the intention to limit the invention in any way thereto, the following drawings are provided:

FIG. 1 is a perspective view of a catalytic converter of the present invention shown in disassembled relation.

DETAILED DESCRIPTION OF EMBODIMENTS

Referring to FIG. 1, in one use of the present invention a pollution control device 10 comprises metallic casing 11 with generally frusto-conical inlet and outlet ends 12 and 13, respectively. Disposed within casing 11 is a pollution control monolith 20. In accordance with a particular embodiment of the invention, the pollution control monolith 20 is a diesel pollution control monolith e.g. formed of a honeycombed monolithic body having a plurality of gas flow channels (not shown) there through. The pollution control monolith 20 may also be one that is adapted for the treatment of exhaust from gasoline engines. The mounting mat of this invention is nevertheless particularly suitable for use with diesel pollution control monoliths and the invention will thus be further described with reference to the treatment of diesel engine exhaust without however the intention to limit the invention thereto. Surrounding diesel pollution control monolith 20 is mounting mat 30 comprising a layer of long and short inorganic fibers, for example long and short chopped or otherwise segmented (e.g., by breaking the fibers in subsequent fiber or mat processing) aluminium silicate glass fibers, which serves to tightly but resiliently support monolithic element 20 within the casing 11. Mounting mat 30 holds diesel pollution control monolith 20 in place in the casing and seals the gap between the diesel pollution control monolith 20 and casing 11 to thus prevent or minimize diesel exhaust gases from by-passing diesel pollution control monolith 20.

The term "diesel pollution control element" is meant to refer to a structure that is suitable for and/or adapted for reducing the pollution caused by exhaust from a diesel engine and in particular includes monolithic structures that are operative in reducing the pollution at low temperatures, e.g. of 350° C. or less. Diesel pollution control elements include without limitation catalyst carriers, diesel particulate filter elements or traps and NOx absorbers or traps.

The metallic casing can be made from materials known in the art for such use including stainless steel.

Examples of diesel pollution control monoliths for use in the pollution control device 10 include catalytic converters and diesel particulate filters or traps. Catalytic converters contain a catalyst, which is typically coated on a monolithic structure mounted within a metallic housing. The catalyst is typically adapted to be operative and effective and low temperature, typically not more than 350° C. The monolithic structures are typically ceramic, although metal monoliths have also been used. The catalyst oxidizes carbon monoxide and hydrocarbons and reduces the oxides of nitrogen in exhaust gases to control atmospheric pollution. While in a gasoline engine all three of these pollutants can be reacted simultaneously in a so-called "three way converter", most diesel engines are equipped with only a diesel oxidation catalytic converter. Catalytic converters for reducing the oxides of nitrogen, which are only in limited use today for diesel engines, generally consist of a separate catalytic converter. Suitable ceramic monoliths used as catalyst supports are commercially available from Corning Inc. (Corning N.Y.) under the trade name of "CELCOR" and commercially available from NGK Insulated Ltd (Nagoya, Japan) under the trade name of "HONEYCERAM", respectively.

Diesel particulate filters or traps are typically wall flow filters, which have honeycombed, monolithic structures typically made from porous crystalline ceramic materials. Alternate cells of the honeycombed structure are typically plugged such that exhaust gas enters in one cell and is forced through the porous wall to an adjacent cell where it can exit the structure. In this way, the small soot particles that are present in diesel exhaust gas are collected. Suitable Diesel particulate filters made of cordierite are commercially available from Corning Inc. (Corning N.Y.) and NGK Insulated Inc. (Nagoya, Japan). Diesel particulate filters made of Silicon Carbide are commercially available from Ibiden Co. Ltd. (Japan) and are described in, for example, JP 2002047070A.

The fibers of the mixture of long and short fibers are preferably non-respirable. The fibers typically have an average diameter of at least 5 μm. Preferably, the average diameter will be at least 7 μm and is typically in the range of 7 to 14 μm. Generally the mixture of long and short fibers is a mixture of continuously formed ceramic fibers, for example glass fibers. Typically the short fibers have length of not more than 13 mm, for example not more than 10 or 8 mm. The long fibers typically have a length of at least 20 mm, for example at least 25 mm or in a particular embodiment at least 30 mm. The maximum length of the long fibers is not particularly critical but is conveniently up to about 15 cm. The amount of short fibers is typically at least 3% by weight based on the total weight of the mixture of long and short fibers, for example at least 5% by weight or in a particular embodiment at least 6% by weight. Typically, the mixture of long and short fibers will constitute at least 50% by weight of the fibers in the layer, for example at least 80% by weight and typically may be 90 or about 100% by weight of the total weight of fibers in the layer. Generally it will be desired that the short fibers are homogeneously distributed throughout the fiber layer. By 'homogeneous' in this context should understood that there is no or only a small amount of areas in the layer where short fibers are concentrated. In other words, the fiber layer should appear fairly uniform. Nevertheless, a non-uniform or heterogeneous distribution of the short fibers within the layer can be used as well but then it will generally be necessary to use a large amount of short fibers to obtain the aforementioned advantages.

The layer comprising the mixture of short and long fibers may contain other fibers including fibers having a length between 13 and 20 mm. In a particular embodiment, the mixture of short and long fibers is a mixture of glass fibers, in particular a mixture of magnesium aluminium silicate glass fibers. In a particular embodiment, the fiber layer of the mounting mat comprises a mixture of long and short magnesium aluminium silicate glass fibers that constitute at least 50% by weight of the total weight of fibers in the layer of the mounting mat. In a particular embodiment, the amount of the mixture is at least 60% or at least 80% and in a typical embodiment substantially all (90 to 100%) of the fiber layer is constituted by the mixture of long and short aluminium silicate glass fibers.

The fibers are preferably individualized. To provide individualized (i.e., separate each fiber from each other) fibers, a tow or yarn of fibers can be chopped, for example, using a glass roving cutter (commercially available, for example, under the trade designation "MODEL 90 GLASS ROVING CUTTER" from Finn & Fram, Inc., of Pacoima, Calif.), to the desired length. The fibers typically are shot free or contain a very low amount of shot, typically less than 1% by weight based on total weight of fibers. Additionally, the fibers are typically reasonably uniform in diameter, i.e. the amount of fibers having a diameter within +/−3 μm of the average is generally at least 70% by weight, preferably at least 80% by weight and most preferably at least 90% by weight of the total weight of the fibers.

The mat may comprise a mixture of different fibers, for example a mixture of magnesium aluminium silicate glass fibers with other fibers such as for example aluminium silica fibers or polycrystalline fibers. Preferably however, the mat will contain only, substantially all or mostly magnesium aluminium silicate glass fibers. If other fibers are contained in the mat, they may be contained in the layer of the mixture of short and long fibers or they can be present in a separate layer or portion of the mounting mat. Generally, the further fibers other than the magnesium aluminium silicate glass fibers will be amorphous fibers and they should preferably also have an average diameter of at least 5 μm. Preferably, the mat will be free or essentially free of fibers that have a diameter of 3 μm or less, more preferably the mat will be free or essentially free of fibers that have a diameter of less than 5 μm. Essentially free here means that the amount of such small diameter fibers is not more than 2% by weight, preferably not more than 1% by weight of the total weight of fibers in the mat.

Examples of magnesium aluminium silicate glass fibers that can be used in this invention include glass fibers having between 10 and 30% by weight of aluminium oxide, between 52 and 70% by weight of silicon oxide and between 1 and 12% of magnesium oxide. The weight percentage of the aforementioned oxides are based on the theoretical amount of $Al_2O_3$, $SiO_2$ and MgO. It will further be understood that the magnesium aluminium silicate glass fiber may contain additional oxides. For example, additional oxides that may be present include sodium or potassium oxides, boron oxide and calcium oxide. Particular examples of magnesium aluminium silicate glass fibers include E-glass fibers which typically have a composition of about 55% of $SiO_2$, 11% of $Al_2O_3$, 6% of $B_2O_3$, 18% of CaO, 5% of MgO and 5% of other oxides; S and S-2 glass fibers which typically have a composition of about 65% of $SiO_2$, 25% of $Al_2O_3$ and 10% of MgO and R-glass fibers which typically have a composition of 60% of $SiO_2$, 25% of $Al_2O_3$, 9% of CaO and 6% of MgO. E-glass, S-glass and S-2 glass are available for example from Advanced Glassfiber Yarns LLC and R-glass is available from Saint-Gobain Vetrotex.

In a particular method for making the mounting mat, the fibers can be cut or chopped and then separated by passing them through a conventional two zone Laroche Opener (e.g. commercially available from Laroche S.A., Cours la Ville, France). The fibers can also be separated by passing them through a hammer mill, preferably a blow discharge hammer mill (e.g., commercially available under the trade designation "BLOWER DISCHARGE MODEL 20 HAMMER MILL" from C.S. Bell Co. of Tiffin, Ohio). Although less efficient, the fibers can be individualized using a conventional blower such as that commercially available under the trade designation "DAYTON RADIAL BLOWER," Model 3C 539, 31.1 cm (12.25 inches), 3 horsepower from W. W. Grainger of Chicago, Ill. The chopped fibers normally need only be passed through the Laroche Opener once. When using the hammer mill, they generally must be passed though twice. If a blower is used alone, the fibers are typically passed through it at least twice. Preferably, at least 50 percent by weight of the fibers are individualized before they are formed into a layer of the mounting mat. It has been found that such separation processing can be used to further segment or break longer than desired fibers into desired lengths.

According to a method for making the mounting mat, chopped, individualized fibers are fed into a conventional web-forming machine (commercially available, for example, under the trade designation "RANDO WEBBER" from Rando Machine Corp. of Macedon, N.Y.; or "DAN WEB" from ScanWeb Co. of Denmark), wherein the fibers are drawn onto a wire screen or mesh belt (e.g., a metal or nylon belt). If a "DAN WEB"-type web-forming machine is used, the fibers are preferably individualized using a hammer mill and then a blower. Fibers having a length greater than about 2.5 cm tend to become entangled during the web formation process. To facilitate ease of handling of the mat, the mat can be formed on or placed on a scrim. Depending upon the length of the fibers, the resulting mat typically has sufficient handleability to be transferred to a needle punch machine without the need for a support (e.g., a scrim).

The inventive mixture of short and long fibers may be achieved by feeding a mixture of the desired short and long fibers in the web-forming machine. Alternatively, only longer than desired fibers may be fed into the web forming machine and the conditions of individualization and/or web forming will be set such as to deliberately cause a certain amount of the fibers to break rather than setting conditions that avoid breaking of fibers as is normally the case. The method of in-situ segmenting or breaking of fibers is particularly suitable for generating a homogeneous distribution of fibers in the fiber layer. However, it is also possible to feed a desired mixture into the web forming process. Also a combination of feeding a mixture of the desired short and long fibers and conditions that cause breaking of a certain amount of longer than desired fibers can be practiced.

Breakage or other segmenting of fibers in the making of the mounting mat may be caused by applying stress to the individual fibers, e.g. by feeding fiber strands (bundles) through a gap, clamp fibers in the gap while fast rotating the lickerin roll or by using a lickerin roll with pins or teeth that cause breakage of the fibers. Breakage of fibers may be caused in either or both of the opening or web-forming stage.

In a particular embodiment, the mounting mat is a needle-punched non-woven mat. A needle-punched nonwoven mat refers to a mat wherein there is physical entanglement of fibers provided by multiple full or partial (preferably, full) penetration of the mat, for example, by barbed needles. The nonwoven mat can be needle punched using a conventional needle punching apparatus (e.g., a needle puncher commercially available under the trade designation "DILO" from Dilo of Germany, with barbed needles (commercially available, for example, from Foster Needle Company, Inc., of Manitowoc, Wis.)) to provide a needle-punched, nonwoven mat. Needle punching, which provides entanglement of the fibers, typically involves compressing the mat and then punching and drawing barbed needles through the mat. The optimum number of needle punches per area of mat will vary depending on the particular application. Typically, the nonwoven mat is needle punched to provide about 5 to about 60 needle punches/cm'. Preferably, the mat is needle punched to provide about 10 to about 20 needle punches/cm'.

Preferably, the needle-punched, nonwoven mat has a weight per unit area value in the range from about 1000 to about 3000 $g/m^2$, and in another aspect a thickness in the range from about 0.5 to about 3 centimeters. Typical bulk density under a 5 kPA load is in the range 0.1-0.2 g/cc.

The nonwoven mat can be stitchbonded using conventional techniques (see e.g., U.S. Pat. No. 4,181,514 (Lefkowitz et al.), the disclosure of which is incorporated herein by reference for its teaching of stitchbonding nonwoven mats). Typically, the mat is stitchbonded with organic thread. A thin layer of an organic or inorganic sheet material can be placed on either or both sides of the mat during stitchbonding to prevent or minimize the threads from cutting through the mat. Where it is desired that the stitching thread not decompose in use, an inorganic thread, such as ceramic or metal (e.g., stainless steel) can be used. The spacing of the stitches is usually from 3 to 30 mm so that the fibers are uniformly compressed throughout the entire area of the mat.

In accordance with a particular embodiment of the present invention, the mat may be comprised of a plurality of layers of magnesium aluminium silicate glass fibers, at least one of which will has a mixture of short and long fibers. Such layers may be distinguished from each other in the average diameter of the fibers used, the length of the fibers used and/or the chemical composition of the fibers used. Since the heat resistance and mechanical strength of fibers at temperature vary with their composition and to a lesser degree fiber diameter, fiber layers can be selected to optimize performance while minimizing cost. For example, a nonwoven mat consisting of a layer of S-2 glass combined with a layer of E-glass can be used to mount a diesel catalytic converter. In use the S-2 glass layer is placed directly against the hotter, monolith side of the catalytic converter while the E-glass layer is against the cooler, metal housing side of the catalytic converter. The layered combination mat can withstand considerably higher temperatures than a mat consisting of only E-glass fibers at greatly reduced cost compared to a mat consisting of only S-2 glass fibers. The layered mats are made by first forming the individual non-woven layers having a specific type of fiber using the forming techniques described earlier. These layers are then needle bonded together to form the finished mat having the desired discrete layers.

The mounting mats of the invention are particularly suitable for mounting a diesel pollution control monolith in a pollution control device. Typically, the mount density of the mat, i.e. the bulk density of the mat after assembly, should be at least 0.2 g/cm$^3$ to provide sufficient pressure to hold the monolith securely in place. At mount densities above about 0.70 g/cm$^3$ the fibers can be unduly crushed. Also at very high mount density there may be a risk that the monolith breaks during assembly of the pollution control device. Preferably, the mount density should be between about 0.25 g/cm$^3$ and 0.45 g/cm$^3$. The pollution control device has excellent performance characteristics for use in low temperature applications such as in the treatment of diesel engine exhaust. The pollution control device may be used in a stationary machine to treat the exhaust emerging from a diesel engine contained therein. Such stationary machines include for example power sources for generating electricity or pumping fluids.

The pollution control device is in particular suitable for the treatment of exhaust from diesel engines in motor vehicles. Examples of such motor vehicles include trains, buses, trucks and 'low capacity' passenger vehicles. By 'low capacity' passenger vehicles is meant a motor vehicle that is designed to transport a small number of passengers, typically not more than 15 persons. Examples thereof include cars, vans and so-called mono-volume cars. The pollution control device is particularly suitable for the treatment of exhaust from turbo charged direct injection diesel engines (TDI) which are more and more frequently used in motor vehicles in particular in Europe.

The following examples further illustrate the invention without however intending to limit the scope of the invention thereto.

EXAMPLES

Materials Employed in the Examples

R-glass fibers (RC-10 P109) of approximately 10 μm in average diameter and 36 mm in length were used. (obtained from Saint-Gobain Vetrotex France SA, Chambery Cedex, France.)

Test Methods

Fiber Length Measurement

A fiber length measurement was conducted on samples from the mats prepared in the examples to determine the amount of fibers having a length of less than 12.7 mm.

The test equipment comprised a balance to detect the weight of the samples, a zone where the fiber bundles were separated for single fiber measurement and a zone where the single fibers were transported pneumatically passed an optical sensor. The specific device employed was a measurement device commercially available as Model "Advanced Fiber Information System" (AFIS) (USTER Technologies AG, Uster, Switzerland). The instrument was employed in the "L-module" mode for measurement of fiber length. The machine was calibrated using polyester fibers of known length.

Ten samples of fibers, each weighing ca. 0.5 g, were taken from the mat to be tested. Each sample was then weighed on the AFIS tester. The sample was then placed manually onto the transport band, ensuring that bundle of fibers was oriented so that the fibers were parallel to the direction of transport.

The fibers were automatically fed into the separation zone where a counter-rotating carding roll bearing fine needles separated the fiber bundles into single fibers. The fibers were then further transported pneumatically via an airstream with a defined velocity past an optical infrared sensor. This sensor detected the number of single fibers and their length. The measurement was terminated after 3000 fibers were detected.

Test results were displayed as a graph showing frequency of fibers (%) vs. fiber length (mm). From the graph, the percentage of fibers having a length of less than 12.7 mm was derived using software integrated into the AFIS system. The ten measurements were averaged and reported. The percentage reported was based on W, the median length of the fiber based on weight.

Static Compression Test

A static compression test was conducted at ambient conditions on the mats prepared in the examples to determine their resistance to compression. The test equipment comprised two anvils that could be advanced toward one another, thus compressing a mat sample that had been placed between them. The specific device employed was a Material Test System Model RT/30 (available from MTS Alliance™, Eden Prairie Minn., USA). The device was fitted with a 5 kN load cell to measure the resistance of the sample mat to compression and height measuring device for measuring the thickness of the sample at various stages of compression.

Samples were prepared by taking circular die-cuts with a diameter of 50.8 mm from the finished mounting mat. Three samples were taken at equally spaced intervals across the width of the mat at least 25 mm from the edge. The distance between the samples was at least 100 mm. Each of the samples had a weight per area of ca. 1300 g/m$^2$ (+/−15%). The test was conducted by the following procedure. Each sample was first weighed. Then the weight per area of each sample was calculated by dividing the weight of the sample by the surface area of the sample (calculated from the known diameter of 50.8 mm) and was recorded in g/mm$^2$.

The gap between the anvils that was necessary to reach a final compressed density of 0.40 g/cm$^3$ was then calculated. This is the desired density where the resistance to compression is to be measured.

Example Calculation:

$$\text{Gap size in cm} = \frac{\text{Weight per area in g/cm}^2}{\text{Initial Density in g/cm}^3}$$

Thus a sample with the weight per area of 1300 g/m$^2$ and an initial density of ca. 0.15 g/cm$^3$, would need to be compressed to a thickness of 0.325 cm (3.25 mm) to obtain a final density of 0.4 g/cm$^3$. The sample was then placed on the lower anvil of the test equipment. The gap between the anvils was then closed at a rate of 25.4 mm per minute, starting from 20 mm distance between the anvils. The advancement of the anvils was then stopped at the gap between the anvils that was calculated above.

After a period of 45 seconds of compression at the calculated gap distance, the resistance to compression was measured and recorded in kPa.

Example 1

R-glass P109 fibers of approximately 10 μm in average diameter and 36 mm in length were obtained from Saint- Gobain Vetrotex France SA, Chambery Cedex, France. The fibers were essentially shot free.

An amount of 40 kg of glass fibers was opened in a La Roche opener having a lickerin roll equipped with pins. The strands were fed directly into the second zone with a feed speed of 3 m/min and a lickerin roll speed of 2,000 rpm. The output speed was 6.0 m/min. The opened fibers were then fed into a conventional web-forming machine Rando webber wherein the fibers were blown onto a porous metal roll to form a continuous web. The lickerin roll had teeth, the lickerin speed was 1900 rpm, elevator speed 300 rpm, stripper speed 350 rpm. Feed roll speed was 1.1 rpm, depression of feeder was 7.5 psi, depression of webber was 7 psi. The lid opening was 30 mm. Line speed was 1 m/min.

The continuous web was then needle-bonded on a conventional needle tacker. Needle type GB15×16×3½R222G53047 (Groz-Beckert Group, Germany). The needle density was 1.2 needles per $cm^2$ randomized with a top board graduation of 19. The needle board worked from the top with a needle frequency of 100 cycles/min. Input speed was 1 m/min and the output speed was 1.05 m/min. The penetration of the needles was 10 mm, the product had a density of 24 punches per $cm^2$ Rando basis weight was 1000 $g/m^2$.

The opening process was run under conventional conditions, the web forming however was very aggressive due to the fact that a lickerin roll with teeth was used instead of one with pins. This resulted in a 10.5 percentage of fibers having a length shorter than 12.7 mm.

Table 1 summarizes the process parameters for the production of example 1. Also in table 1 there is the amount in % of fibres having a length shorter than 12.7 mm, measured following the above described test method. In table 1 the process parameters for each example were divided into the classifications smooth, moderate, aggressive, irrespective of the process step where the most breakage was caused. The static compression test result can be found in table 1.

Example 2

Example 2 was prepared by the method described in Example 1 with the exception that a La Roche pre-opener and fine-opener was used each having a lickerin roll equipped with pins.

The rotation speed was 2000 rpm for both opener rolls, the gap in the pre-opener was 0.8 mm, the gap of the fine-opener was 2 mm for example 2.

The webber used for the production of example 2 was a La Roche webber in which the lickerin roll was equipped with pins. The rotational speed was 2000 rpm. Line speed was 2.4 m/min.

The needling process was done on a Dilo™ tacker with a top and a bottom board. The penetration depth was 15 mm, needle frequency was 330 hubs per minute. Line speed of the tacker was 3 m/min.

The opening process was run under aggressive conditions, obtained by rather small gap openings between clamped fibers and pins of the lickerin roll in both opening steps. Individual fibers are hit more effectively by the pins of the lickerin roll while feeding them through a small gap. The web forming however was designed to avoid fiber breakage due to the fact that a lickerin roll with pins was used instead of one with teeth. The Uster AFIS test method showed 6.5% of fibers with length of less than 12.7 mm.

Example 2 was tested in the Cold Compression Test as described above. Results are summarized in Table 1.

Example 3

Example 3 was prepared by the method described in Example 2 with the exception that the gap in the first opener was 2 mm, the gap of the second opener was 3 mm.

The web formation as well as needle tacking was proceeded by the same method as described in example 2 with the one exception that the needling frequency was 300 hubs per min.

The opening process was run under moderate conditions, obtained by moderate gap openings in both opening steps. The small gap of 2 mm and 3 mm caused less fiber breakage than in example 2. This can be seen from the Uster AFIS test method resulting in 4.3% of fibers with length of less than 12.7 mm.

Example 3 was tested in the Cold Compression Test as described above. Results are summarized in Table 1.

Example 4

Example 4 was prepared by the method described in Example 2 with the exception that the opener was fed with a fiber blend consisting of 80 weight % R-glass fibers, diameter about 10 μm, chopped to a length of 1.5 inches (36 mm), (obtainable as R-glass dispersible chopped strands from Saint-Gobain Vetrotex France SA, Chambery Cedex, France,) and 20 weight % R-fibers, diameter about 10 μm, chopped to a length of 0.5 inches (12 mm), (obtainable from same supplier).

The web formation as well as needle tacking was proceeded by the same method as described in example 2. The process parameters are summarized in table 1.

The mechanical stress on the fibers in the 0.8 mm and 2 mm gaps is similar as described in example 2.

Example 4 was tested in the Cold Compression Test as described above. Results are summarized in Table 1.

Example 5

Example 5 was prepared by the method described in Example 2 with the exception that the fibers were aggressively pre-opened through a third opener, before being processed through the first and second openers, the gap in the first opener was 3 mm and the gap of the second opener was 4 mm. The third opener was set with a gap of 1.0 mm and is made by the same manufacturer as opener 2 (commercially available from Laroche S.A., Cours la Ville, France), but uses twice the number of pins found in opener 2.

The web formation as well as needle tacking was proceeded by the same method as described in example 2. The process parameters of example 5 are summarized in Table 1.

Example 5 was tested in the Cold Compression Test as described above. Results are summarized in Table 1.

Comparative Example 1

Comparative Example 1 was prepared by the method described in Example 3 with the exception that the gap in the first opener was 3 mm, the gap of the second opener was 4 mm.

The web formation as well as needle tacking was proceeded by the same method as described in example 3.

The opening process was run under smooth conditions, obtained by wide gap openings in both opening steps. The stress that occurred in the 3 mm and 4 mm gaps caused less fiber breakage than in example 2 and 3. The process parameters of comparative example 1 are summarized in Table 1. Test results can be found in table 1.

TABLE 1

| Example | Fiber input 36 mm/ 12 mm | opener 1 Gap (mm) | opener 2 gap (mm) | Webber lickerin roll type | % of fibers shorter than 12.7 mm | Static compression (kPa) | Web preparation conditions |
|---|---|---|---|---|---|---|---|
| 1 | 100/0 | none | none | teeth | 10.5 | 490 | very aggressive |
| 2 | 100/0 | 0.8 | 2.0 | pins | 6.5 | 270 | aggressive |
| 3 | 100/0 | 2.0 | 3.0 | pins | 4.3 | 209 | moderate |
| 4 | 80/20 | 0.8 | 2.0 | pins | Not measured | 299 | aggressive |
| 5 | 100/0* | 3.0 | 4.0 | pins | Not measured | 304 | aggressive |
| Comp 1 | 100/0 | 3.0 | 4.0 | pins | Not measured | 189 | smooth |

*aggressively pre-opened

The invention claimed is:

1. A mat comprising a layer having a plurality of inorganic fibers comprising a mixture of long and short inorganic fibers constituting at least 50% by weight of said plurality of fibers in said layer, said short fibers having a length of not more than about 13 mm, said long fibers having a length of at least about 20 mm, the amount of said short fibers being at least about 3% by weight based on the total weight of said mixture of long and short fibers.

2. The mat according to claim 1 wherein said mixture of long and short fibers is a mixture of long and short glass fibers.

3. The mat according to claim 1 wherein at least about 90% by weight, based on the total weight of said layer, of said mixture of long and short fibers are magnesium aluminium silicate glass fibers.

4. The mat according to claim 1 wherein the amount of said short fibers is at least about 5% by weight.

5. The mat according to claim 1 wherein the length of said long fibers is at least about 25 mm.

6. The mat according to claim 1 wherein said short and said long fibers together constitute at least about 80% by weight of the fibers of said layer having said mixture of long and short fibers.

7. The mat according to claim 1 wherein the mat comprises a single layer of chopped magnesium aluminium silicate glass fibers.

8. The mat according to claim 1 wherein the mat comprises two or more layers of chopped magnesium aluminium silicate glass fibers, at least one of said layers comprising a mixture of said long and said short glass fibers.

9. The mat according to claim 1 wherein said mat exhibits a static compression test result of at least about 200 kPa.

10. The mat according to claim 1 wherein said mat exhibits a static compression test result of at least about 250 kPa.

11. The mat according to claim 7 wherein at least about 90% by weight, based on the total weight of said layer, of said mixture of long and short fibers are magnesium aluminium silicate glass fibers, the amount of said short fibers is at least about 5% by weight, the length of said long fibers is at least about 25 mm.

12. The mat according to claim 1 wherein said short and said long fibers together constitute at least about 80% by weight of the fibers of said layer having said mixture of long and short fibers, and the mat comprises a single layer of chopped magnesium aluminium silicate glass fibers.

13. The mat according to claim 1 wherein said short and said long fibers together constitute at least about 80% by weight of the fibers of said layer having said mixture of long and short fibers, and the mat comprises two or more layers of chopped magnesium aluminium silicate glass fibers, at least one of said layers comprising a mixture of said long and said short glass fibers.

14. The mat according to claim 7 wherein said mat exhibits a static compression test result of at least about 200 kPa.

15. The mat according to claim 8 wherein said mat exhibits a static compression test result of at least about 250 kPa.

16. A method of making the mat according to claim 1, said method comprising:

providing a plurality of continuously formed inorganic fibers;

segmenting the continuously formed inorganic fibers into long and short fibers, with the short fibers having a length of not more than about 13 mm and the long fibers having a length of at least about 20 mm;

mixing the long and short fibers together to form a fiber mixture; and forming a mat using the mixture of long and short fibers.

17. The method according to claim 16 wherein said segmenting comprises breaking the long and short fibers in the fiber mixture during said mat forming to produce at least one of short fibers having a length of not more than about 13 mm and the long fibers having a length of at least about 20 mm.

18. The method according to claim 16 wherein said segmenting comprises chopping continuously formed inorganic fibers into long and short fibers to produce at least one of short fibers having a length of not more than about 13 mm and the long fibers having a length of at least about 20 mm.

19. The method according to claim 16 further comprising:

chopping the continuously formed inorganic fibers into longer than desired lengths, before performing said segmenting.

20. A machine comprising a mat as defined in claim 1.

* * * * *